US006366255B1

(12) United States Patent
Chiang

(10) Patent No.: US 6,366,255 B1
(45) Date of Patent: Apr. 2, 2002

(54) MAIN REFLECTOR AND SUBREFLECTOR DEPLOYMENT AND STORAGE SYSTEMS

(75) Inventor: Jason J. Chiang, Fremont, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/663,544

(22) Filed: Sep. 15, 2000

(51) Int. Cl.[7] ..... H01Q 1/12; H01Q 1/28
(52) U.S. Cl. ..... 343/781 P; 343/882; 343/DIG. 2
(58) Field of Search ..... 343/781 P, DIG. 2, 343/882; H01Q 1/12, 1/28

(56) References Cited

U.S. PATENT DOCUMENTS 4,562,441 A * 12/1985 Beretta et al. ..... 343/781 P
6,124,835 A * 9/2000 Nguyen et al. ..... 343/DIG. 2

* cited by examiner

*Primary Examiner*—Michael C. Wimer
(74) *Attorney, Agent, or Firm*—Kenneth W. Float

(57) ABSTRACT

Deployable antenna systems for use on a spacecraft that is moveable from a stowed position to a deployed position. Two embodiments are disclosed that include one or two sets of main reflector assembly (and optional adjustment mechanism) and subreflectors. The antenna systems include a feed horn assembly fixedly attached to the spacecraft and a rotatable hinge attached to the spacecraft. A substantially rigid reflector support structure is attached to the hinge and rotates about a hinge axis. The main reflector assembly (and optional adjustment mechanism) is attached to a lower portion of the support structure and the subreflector is attached to an upper portion of the support structure. The subreflector has a fixed relation relative to the main reflector assembly and has a fixed relation relative to the feed horn assembly when the antenna system is in the deployed position so that the antenna systems generate predetermined beam coverage patterns.

11 Claims, 7 Drawing Sheets

MAIN REFLECTOR AND SUBREFLECTOR DEPLOYMENT AND STORAGE SYSTEMS

BACKGROUND

The present invention relates generally to spacecraft, and more particularly, to a spacecraft antenna storage and deployment system for use with a spacecraft antenna having a main reflector and a subreflector.

The assignee of the present invention manufactures and deploys communication spacecraft. Such spacecraft have antennas stowed thereon that are deployed once the spacecraft is in orbit. The antennas are used for communication purposes.

A number of deployable antennas have been developed in the past. Many of them are for use in ground-based vehicular applications. For instance, the Winegard Company has patented a variety of deployable antennas that are primarily designed for use on recreational vehicles, and the like. These patents include U.S. Pat. Nos. 5,554,998, 5,528,250, 5,515,065, 5,418,542, 5,337,062, and 4,771,293. The antennas disclosed in these patents have a single main reflector that illuminates a feed horn. These antennas are primarily designed to receive television signals broadcast from a satellite.

U.S. Pat. No. 4,771,293 entitled "Dual Reflector folding Antenna" discloses a folding antenna for use in a satellite communication system that is used as part of a mobile earth station that is part of a satellite communication system for news gathering purposes. This antenna has a supporting base, a main reflector and a subreflector. The main reflector and subreflector rotate downward toward the base from a deployed position to a stowed position where the two reflectors lie relatively close to the base. The base forms part of a container that encloses the reflectors when in the stowed position. The two reflectors are hinged relative to each other and relative to the base. The two reflectors move from a stowed position where they lie relatively close to the base, to a deployed position where they are relatively spaced from the base.

U.S. Pat. No. 5,554,998 entitled "Deployable satellite antenna for use on vehicles" is typical of the other cited patents discloses a deployable satellite antenna system that is intended for mounting on the roof of a vehicle. The elevational position of the reflector is controlled by a reflector support having a lower portion pivotably attached to a base mounted to the vehicle. The elevational position of the reflector can be adjusted between a stowed position in which the reflector is stored face-up adjacent to the vehicle and a deployed position. The feed horn is supported at the distal end of a feed arm having a first segment attached to the reflector support extending outward between the base and reflector, and a second segment pivotably connected to the distal end of the first segment. The feed horn segments move between an extended position in which the feed horn is positioned to receive signals reflected from the reflector, and a folded position in which the feed horn is positioned adjacent to the reflector. A linkage extends between the base and the second segment of the feed arm causing the second segment of the feed arm to automatically pivot to its folded position when the reflector is moved to its stowed position. The linkage also allows a spring to pivot the second segment to its extended position when the reflector is moved to its deployed position. The azimuth of the antenna can be controlled by rotating the base relative to the roof of the vehicle.

The other cited patents generally relate to deployable satellite antennas that have all the major antenna components (i.e. feed horn assembly, subreflector, main reflector) move independently to deploy and stow the antenna. These other patents are generally unrelated to the present invention.

None of the above-cited antennas are particularly well-suited for use on a spacecraft. Single reflector antennas are typically not used in spacecraft communication systems. The dual reflector antennas disclosed in U.S. Pat. No. 4,771,293, as well as the other antennas, have many moving parts and would therefore be relatively unreliable when used in space applications.

It would be desirable to have a system that improves the ability to store and deploy an antenna system comprising a main reflector and a subreflector that is disposed on a spacecraft. Therefore, it is an objective of the present invention to provide for spacecraft antenna deployment and storage system that stores and deploys an antenna having a main reflector and a subreflector as a single moving assembly.

SUMMARY OF THE INVENTION

To accomplish the above and other objectives, the present invention provides for improved systems that are used to store and deploy an antenna disposed on a spacecraft. The antenna comprises an RF feed horn assembly, a main reflector assembly and a subreflector. Alternative embodiments of the present invention package one or two antenna systems each having an RF feed horn assembly, a main reflector assembly and a subreflector.

More particularly, the present invention is a deployable antenna system for use on a spacecraft that is moveable from a stowed position to a deployed position. The antenna system comprises a feed horn assembly comprising one or more feed horns fixedly attached to the spacecraft and a rotatable hinge attached to the spacecraft. A substantially rigid reflector support structure is attached to the hinge that rotates about a hinge axis. The support structure has lower and upper portions. A main reflector assembly (with or without a built-in adjustment mechanism) is attached to the lower portion and a subreflector is attached to the upper portion. The subreflector has a fixed relation relative to the main reflector assembly and is disposed in a fixed relation relative to the feed horn assembly when the antenna system is in the deployed position so that the antenna system generates a predetermined beam coverage pattern.

The present invention provides compact packaging of a spacecraft antenna, especially when the subreflector is relatively large relative to the main reflector. The present invention thus provides for an antenna system having a compact stowage volume. The present invention stows and deploys the main reflector assembly and subreflector as a single unit.

The present invention uses only a single axis deployment mechanism per antenna and deploys the main reflector assembly and subreflector as a single rigid unit. The present invention allows a lightweight, rigid deployment structure being able to provide a smaller misalignment error between the subreflector and main reflector assembly when deployed. The present invention is ideal for deploying an antenna system with a relatively large subreflector, such as a side fed offset Cassegrain antenna, for example, disposed on a side of a spacecraft.

Only one single-axis mechanism is employed per antenna. This is simpler, more reliable and perhaps lighter mass than a two axis mechanism or a dual hinged system such as is disclosed in U.S. Pat. No. 4,771,293, for example. Also there is less pointing error attributed to deployment and thermal distortion due to mismatch of material properties for the present invention. Because of the compact nature of the present invention, it potentially allows a greater number of antenna systems to be disposed on a spacecraft.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1A:
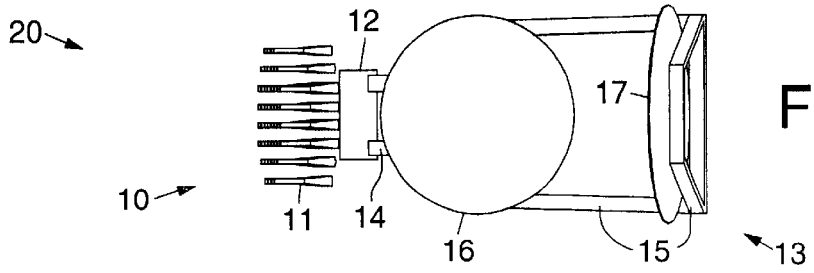
FIGS. 1*a*–1*d* illustrate top, side, end and perspective views, respectively, of an exemplary single spacecraft antenna stowage and deployment system in accordance with the principles of the present invention for use on a spacecraft that is shown in a deployed configuration.
Figure 1B:
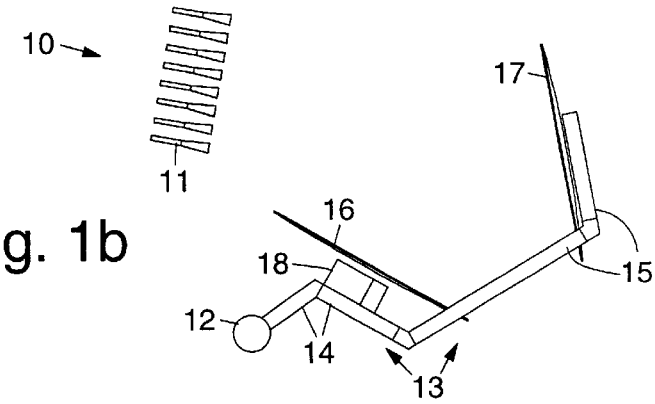
Figure 1C:
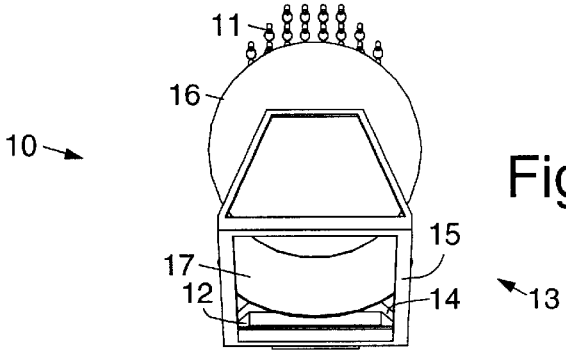
Figure 1D:
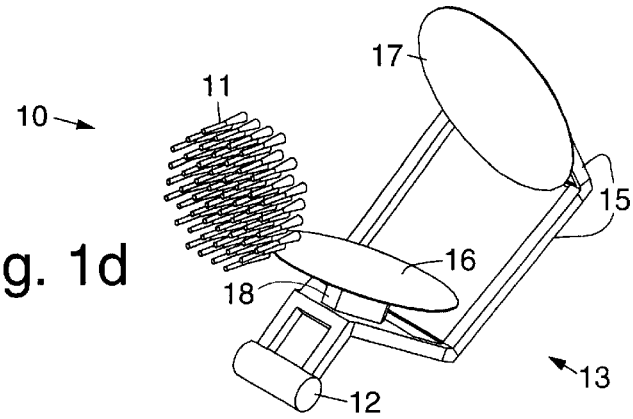
Figure 2A:
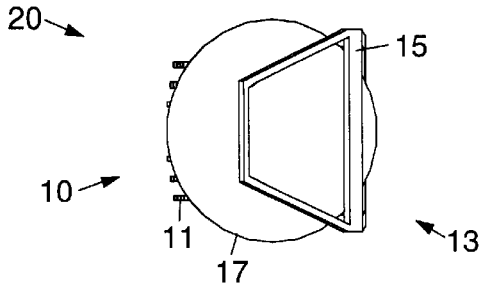
FIGS. 2*a*–2*d* illustrate top, side, end and perspective views, respectively, of the spacecraft stowage and deployment system shown in FIGS. 1*a*–1*d* that is shown in a stowed configuration.
Figure 2B:
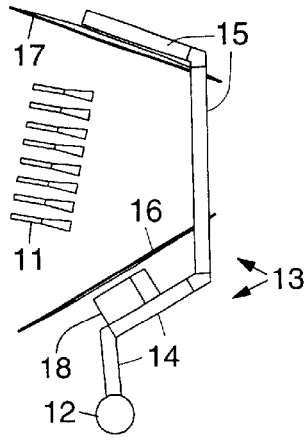
Figure 2C:
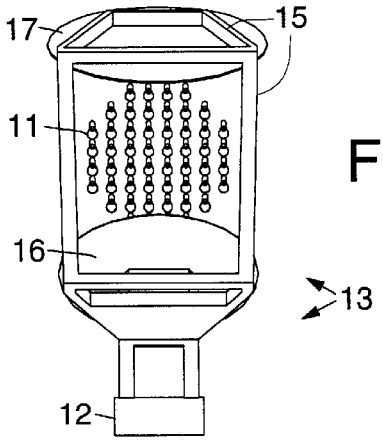
Figure 2D:
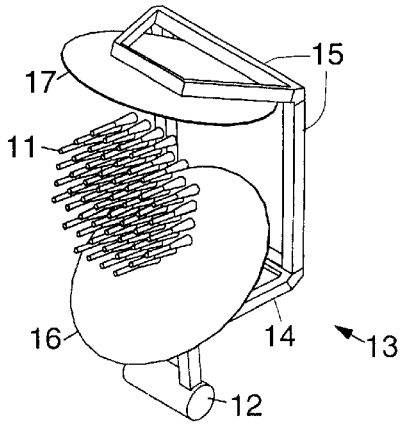

Referring to the drawing figures, FIGS. 1*a*–1*d* illustrate top, side, end and perspective views, respectively, of an exemplary single spacecraft antenna stowage and deployment system 10 in accordance with the principles of the present invention. The antenna system 10 shown in FIGS. 1*a*–1*d* is designed for use on a spacecraft 20 (fully shown in FIG. 7). The deployable antenna system 10 is moveable from a stowed position to a deployed position.

The antenna system 10 shown in FIGS. 1*a*–1*d* is illustrated in a deployed configuration. FIGS. 2*a*–2*d* illustrate top, side, end and perspective views, respectively, of the spacecraft stowage and deployment system 10 shown in FIGS. 1*a*–1*d* illustrated in the stowed configuration.

The antenna system 10 comprise a feed horn assembly 11 fixedly attached to the spacecraft 20, which comprises a fixed body 20. A rotatable hinge 12 is attached to the spacecraft 20. A substantially rigid reflector support structure 13 is attached to the hinge 12 that rotates about a hinge axis. The support structure 13 has lower and upper portions 14, 15.

A main reflector assembly is comprised of a reflector 16 and an optional adjustment mechanism 18. A main reflector assembly 16 (and optional adjustment mechanism 18) is attached to the lower portion 14 of the support structure 13. A subreflector 17 is attached to the upper portion 15 of the support stand is disposed in a fixed relation relative to the main reflector assembly 16 (and optional adjustment mechanism 18) and is disposed in a fixed relation relative to the feed horn assembly 12 when the antenna system 10 is in the deployed position. As a result of the fixed relationship between the feed horn assembly 11, the subreflector 17 and the main reflector assembly 16 (and optional adjustment mechanism 18), the antenna system 10 generates a predetermined beam coverage pattern on the Earth.

Figure 3:
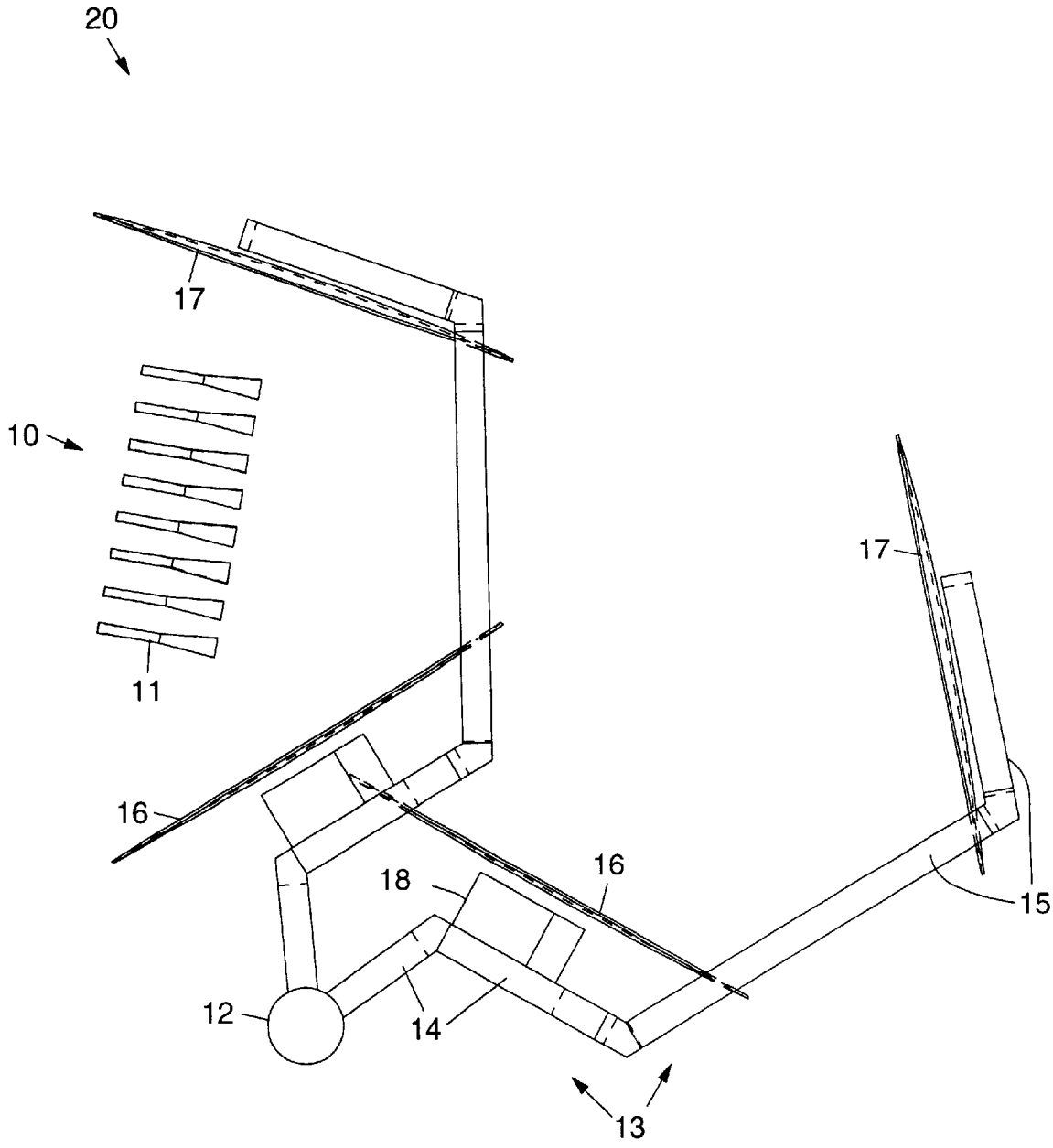
FIG. 3 illustrates the deployment sequence used by the antenna system shown in FIGS. 1*a*–1*d* and 2*a*–2*d;*

FIG. 3 illustrates the deployment sequence used by the antenna system 10 shown in FIGS. 1*a*–1*d* and 2*a*–2*d*. The arrow shown in FIG. 3 illustrates movement of the antenna from a stowed (FIGS. 2*a*–2*d*) position to a deployed position (FIGS. 1*a*–1*d*).

Figure 4A:
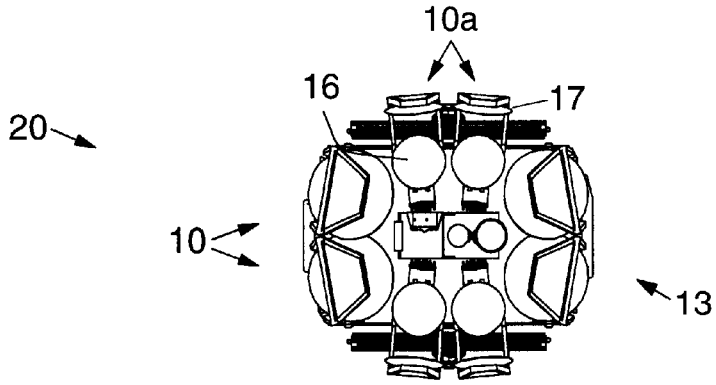
FIGS. 4*a*–4*c* illustrate top and two side views, respectively, of an exemplary dual spacecraft antenna stowage and deployment system in accordance with the principles of the present invention for use on a spacecraft that is shown in a stowed configuration.
Figure 4B:
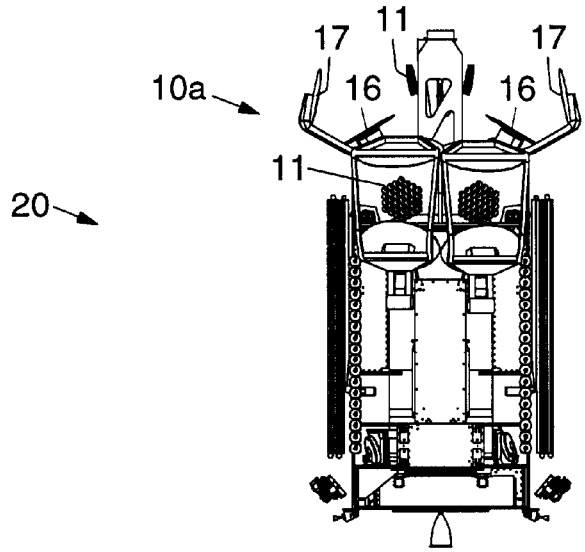
Figure 4C:
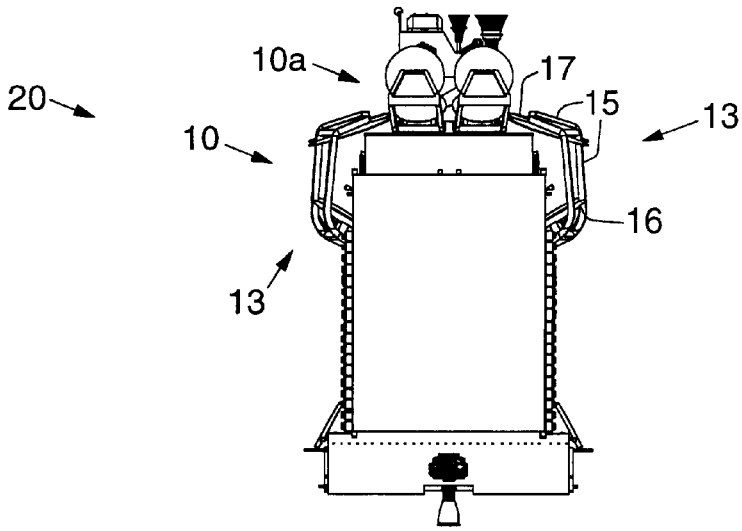

FIGS. 4*a*–4*c* illustrate top, cutaway side and end views, respectively, of an exemplary dual spacecraft antenna stowage and deployment system 10*a* in accordance with the principles of the present invention disposed on a spacecraft 20. Multiple pairs of antenna systems 10 are disposed around the body of the spacecraft 20 as is clearly shown in FIG. 4*a*. The dual spacecraft antenna stowage and deployment system 10*a* is shown in a stowed configuration in FIGS. 4*a*–4*c*.

Figure 5A:
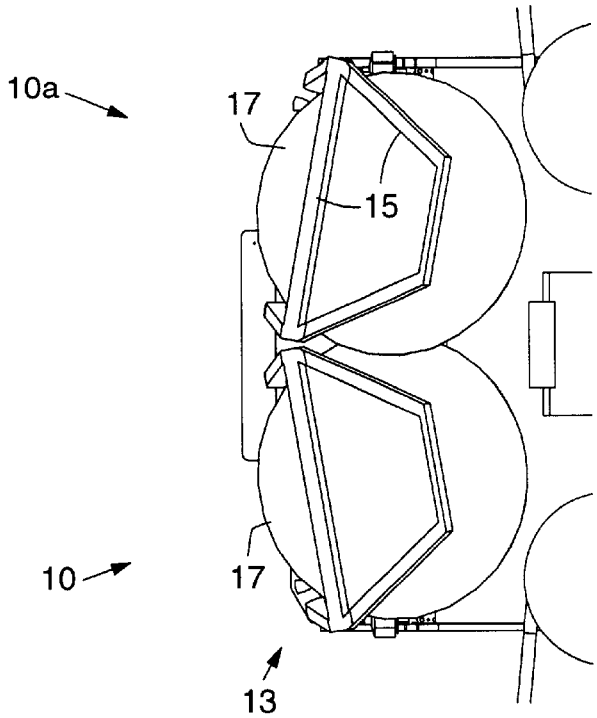
FIGS. 5*a* and 5*b* show stowage details of the spacecraft stowage and deployment system shown in FIGS. 4*a*–4*c;*
Figure 5B:
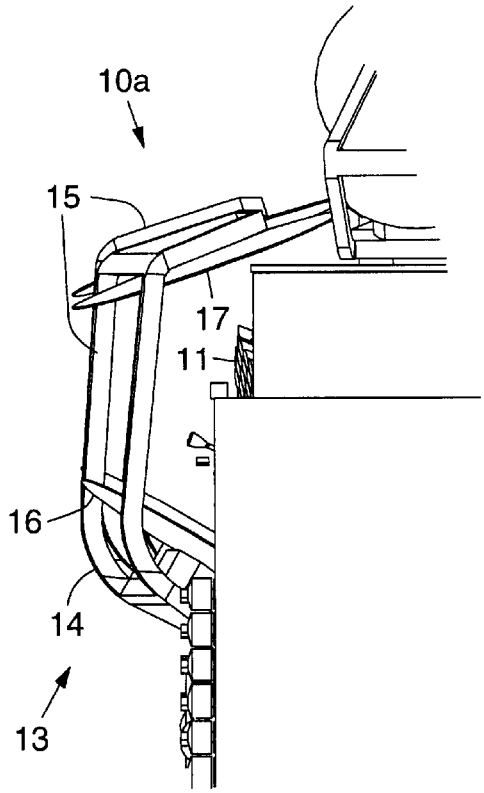

FIGS. 5*a* and 5*b* show stowage details of the dual spacecraft stowage and deployment system 10*a* shown in FIGS. 4*a*–4*c*. FIG. 5*a* is an enlarged view of a portion of the system 10*a* shown in FIG. 4*a*. FIG. 5*b* is an enlarged view of a portion of the system 10*a* shown in FIG. 4*c*. As is shown in FIGS. 5*a* and 5*b*, when the antenna systems 10*a* are in a stowed position, the respective support structures are such that the subreflector 17 of one system 10 lies below the subreflector 17 of the adjacent system 10. The respective hinges 12 are oriented at different angles so that the respective subreflectors 17 and main reflectors 16 deploy without hitting or interfering with each other.

Figure 6A:
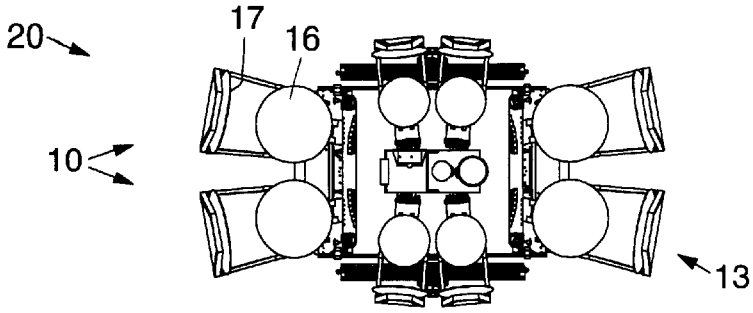
FIGS. 6*a*–6*c* illustrate top and two side views, respectively, of the dual spacecraft antenna stowage and deployment system shown in FIGS. 4*a*–4*c* that is shown in a deployed configuration.
Figure 6B:
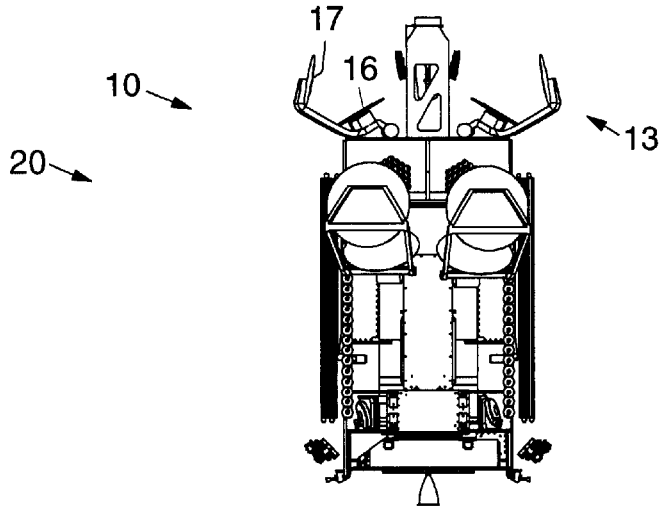
Figure 6C:
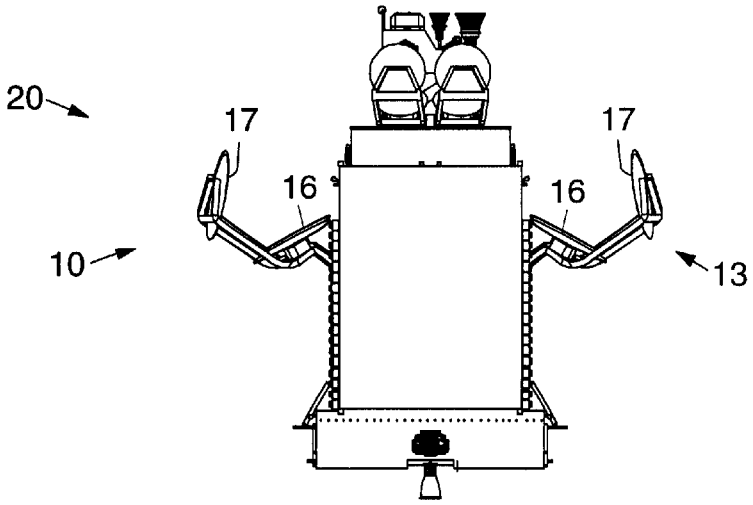

FIGS. 6*a*–6*c* illustrate top, cutaway side and end views, respectively, of the dual spacecraft antenna stowage and deployment system 10*a* shown in FIGS. 4*a*–4*c*. The system 10*a* t is shown in a deployed configuration. The deployment sequence used by the antenna system 10*a* shown in FIGS. 4*a*–4*c* and FIGS. 6*a*–6*c* is substantially the same as shown with reference to FIG. 3.

Figure 7:
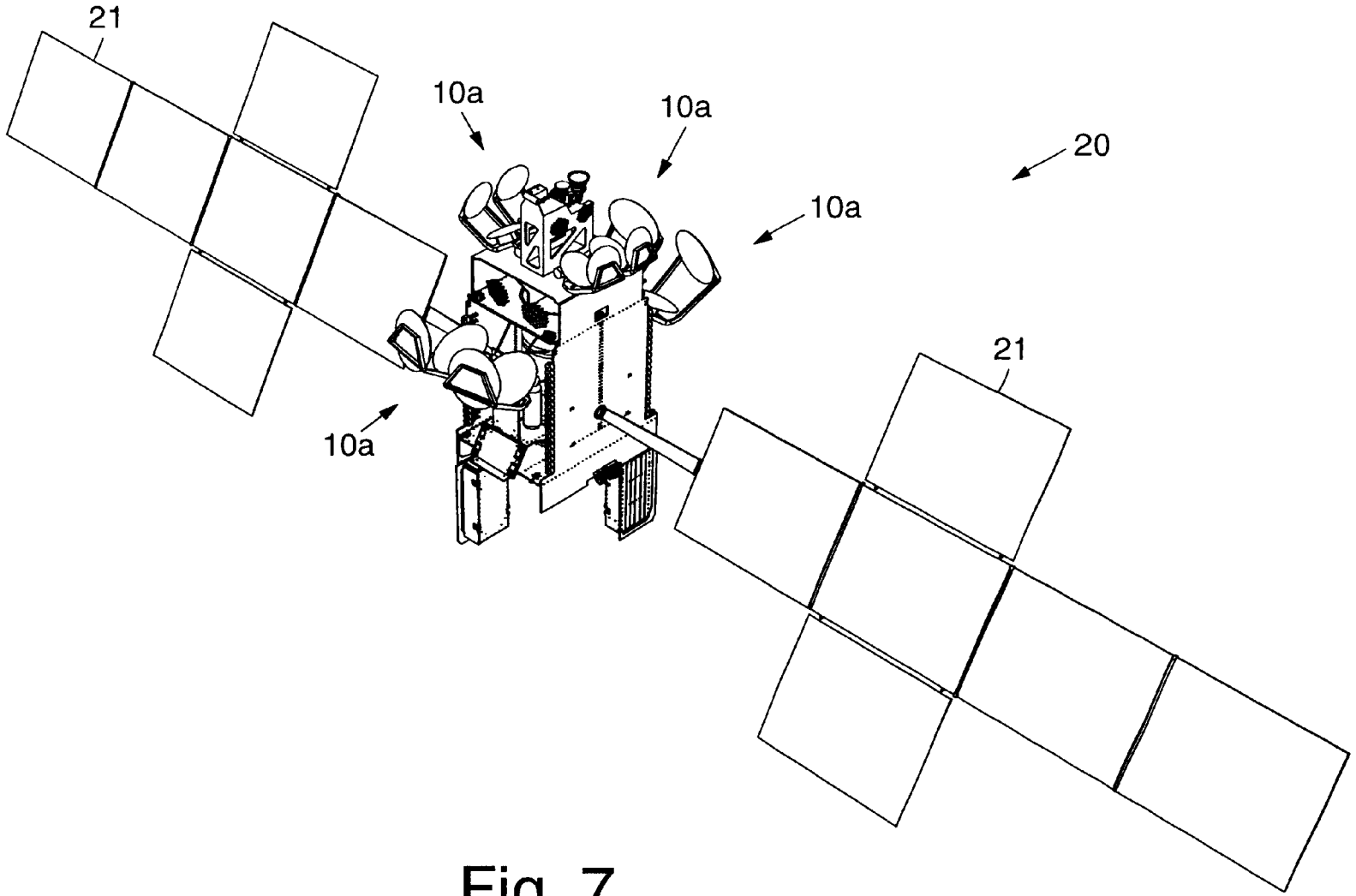
FIG. 7 illustrates an in-orbit spacecraft employing multiple antenna systems in accordance with the principles of the present invention.

FIG. 7 illustrates an in-orbit spacecraft 20 employing multiple antenna systems 10, 10*a* in accordance with the principles of the present invention. The spacecraft 20 is shown as including a plurality of solar panels 21 extending from sides of the spacecraft 20, along with the spacecraft body that includes four dual antenna stowage and deployment systems 10*a*.

Thus, spacecraft antenna storage and deployment systems for use with a spacecraft antenna having a main reflector and subreflector have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A deployable antenna system for use on a spacecraft that is moveable from a stowed position to a deployed position, comprising:

a feed horn assembly fixedly attached to a fixed body;

a rotatable hinge attached to the fixed body;

a substantially rigid reflector support structure attached to the hinge that rotates about a hinge axis, which support structure has lower and upper portions;

a main reflector assembly attached to the lower portion; and a subreflector attached to the upper portion that is disposed in a fixed relation relative to the main reflector assembly and that is disposed in a fixed relation relative to the feed horn assembly when the antenna system is in the deployed position so that the antenna system generates a predetermined beam coverage pattern;

wherein the main reflector assembly and subreflector are rotatable and deployable as a single rigid assembly that rotates about a single axis of the hinge to deploy the antenna system.

2. The system recited in claim 1 wherein the reflector support structure comprises a substantially L-shaped lower portion having a first end attached to the hinge; and a substantially L-shaped upper portion having a first end attached to a second end of the L-shaped lower portion.

3. The system recited in claim 1 wherein the support structure has substantially L-shaped lower and upper portions that secure the main reflector assembly and the subreflector, respectively.

4. The system recited in claim 1 wherein the fixed body comprises a spacecraft.

5. The system recited in claim 1 further comprising an adjustment mechanism coupled to the main reflector assembly.

6. A deployable antenna system for use on a fixed body that is moveable from a stowed position to a deployed position, comprising:

first and second antenna systems that each comprise:

a feed horn assembly fixedly attached to the fixed body;

a rotatable hinge attached to the fixed body;

a substantially rigid reflector support structure attached to the hinge that rotates about a hinge axis, which support structure has lower and upper portions;

a main reflector assembly attached to the lower portion; and a subreflector attached to the upper portion that is disposed in a fixed relation relative to the main reflector assembly and that is disposed in a fixed relation relative to the feed horn assembly when the antenna system is in the deployed position so that the antenna system generates a predetermined beam coverage pattern;

wherein the main reflector assembly and subreflector are rotatable and deployable as a single rigid assembly that rotates about a single axis of the hinge to deploy the antenna system.

7. The system recited in claim 6 wherein the subreflector of the first antenna system overlies a portion of the subreflector of the second antenna system when the system is in a stowed configuration.

8. The system recited in claim 6 wherein the reflector support structure comprises a substantially L-shaped lower portion having a first end attached to the hinge; and a substantially L-shaped upper portion having a first end attached to a second end of the L-shaped lower portion.

9. The system recited in claim 6 wherein the support structure has substantially L-shaped lower and upper portions that secure the main reflector assembly and the subreflector, respectively.

10. The system recited in claim 6 wherein the fixed body comprises a spacecraft.

11. The system recited in claim 6 further comprising an adjustment mechanism coupled to the main reflector assembly.

* * * * *